US005284345A

United States Patent [19]

Jehn

[11] Patent Number: 5,284,345

[45] Date of Patent: Feb. 8, 1994

[54] LASER INDICATOR TO BE USED IN GOLF TRAINING

[76] Inventor: E. F. Jehn, 10F, No. 185, Yung Chi Rd., Taipei, Taiwan

[21] Appl. No.: 966,641

[22] Filed: Oct. 26, 1992

[51] Int. Cl.[5] ..... A63B 69/36

[52] U.S. Cl. ..... 273/187.2; 273/187.6

[58] Field of Search ..... 116/292, 222, 223; 372/109; 362/188, 198, 199, 427; 273/187.2, 187.6, 187.4, 194 R, 186.2; 434/252

[56] References Cited

U.S. PATENT DOCUMENTS

| | | | |
|---|---|---|---|
| 3,953,034 | 4/1976 | Nelson | 273/194 R |
| 4,303,244 | 12/1981 | Uppvall | 273/187.2 |
| 4,456,257 | 6/1984 | Perkins | 273/187.4 |
| 4,601,472 | 7/1986 | O'Flanagan | 273/186.2 |
| 5,165,691 | 11/1992 | Cook | 273/187.4 |
| 5,169,150 | 12/1992 | Tindale | 273/187.4 |
| 5,217,228 | 6/1993 | De Aguilar | 273/187.4 |

*Primary Examiner*—Mark S. Graham

*Attorney, Agent, or Firm*—Lowe, Price, LeBlanc & Becker

[57] ABSTRACT

A laser indicator includes a top shell covered on a bottom shell, which is fastened to the visor of a golf player's cap, through doweled and hooked joints to hold a laser module, a control circuit board and a battery power supply. The laser module has a laser firing lens mount pivotably fastened to the top and bottom shell at the front and is controlled to project a laser beam on the golf ball to be hit by the golf player, in helping the golf player take the correct hitting position.

1 Claim, 10 Drawing Sheets

LASER INDICATOR TO BE USED IN GOLF TRAINING

BACKGROUND OF THE INVENTION

The present invention relates to indicators and relates more particularly to a laser indicator which is to be used in golf training.

In playing the game of golf, a golf player shall have to take a proper position so that the ball can be hit into each of a series of nine or eighteen holes in turn, using the fewest possible strokes. However, it is not easy to a beginner to keep the head and the body in position while hitting the ball. Therefore, a coach may have to frequently correct the posture of a beginner as the beginner is trying to hit the ball into a hole.

SUMMARY OF THE INVENTION

The present invention has been accomplished under the aforesaid circumstances. It is therefore an object of the present invention to provide a laser indicator which uses a laser module controlled to project a laser beam on a golf ball in helping a golf player take the correct position while hitting the ball. It is another object of the present invention to provide a laser indicator which can be conveniently fastened to a player's cap and used in helping the player take the correct position while hitting the ball. It is still another object of the present invention to provide a laser indicator which can be conveniently adjusted to the desired angle.

DETAILED DESCRIPTION OF THE PREFERRED EMBODIMENT

Figure 1:
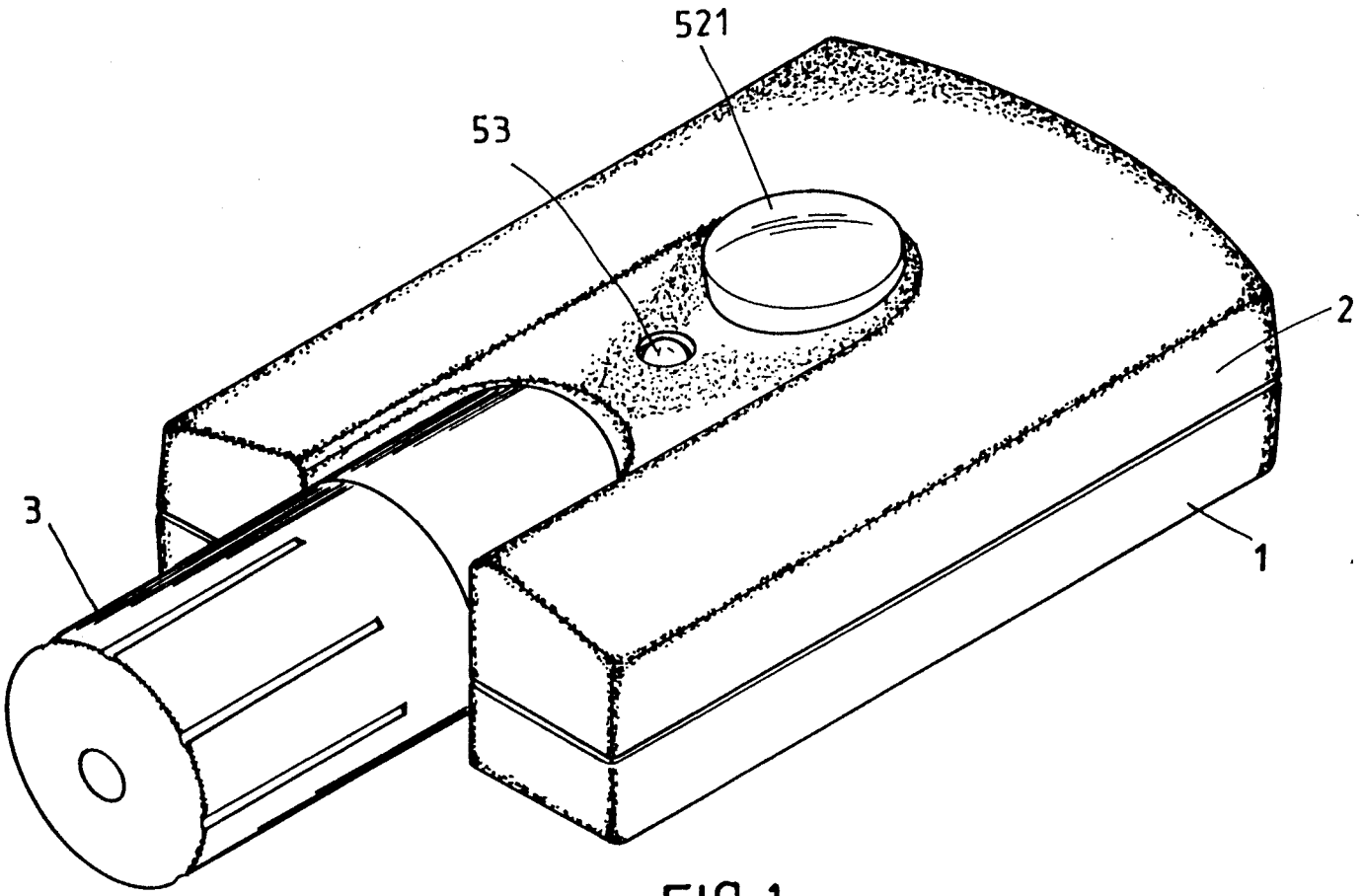
FIG. 1 is an elevational view of a laser indicator embodying the present invention.
Figure 2:
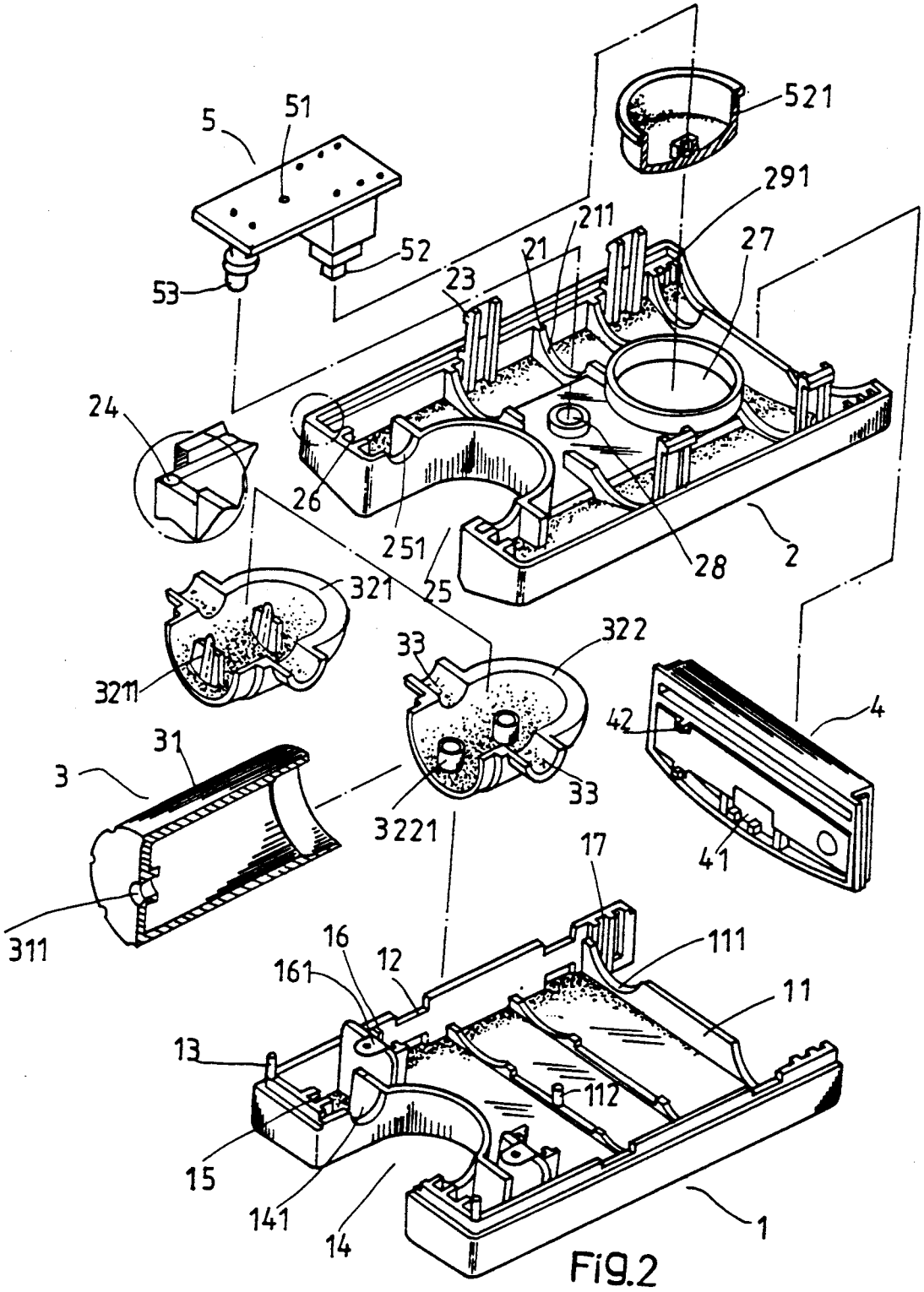
FIG. 2 is a perspective exploded view thereof.
Figure 3:
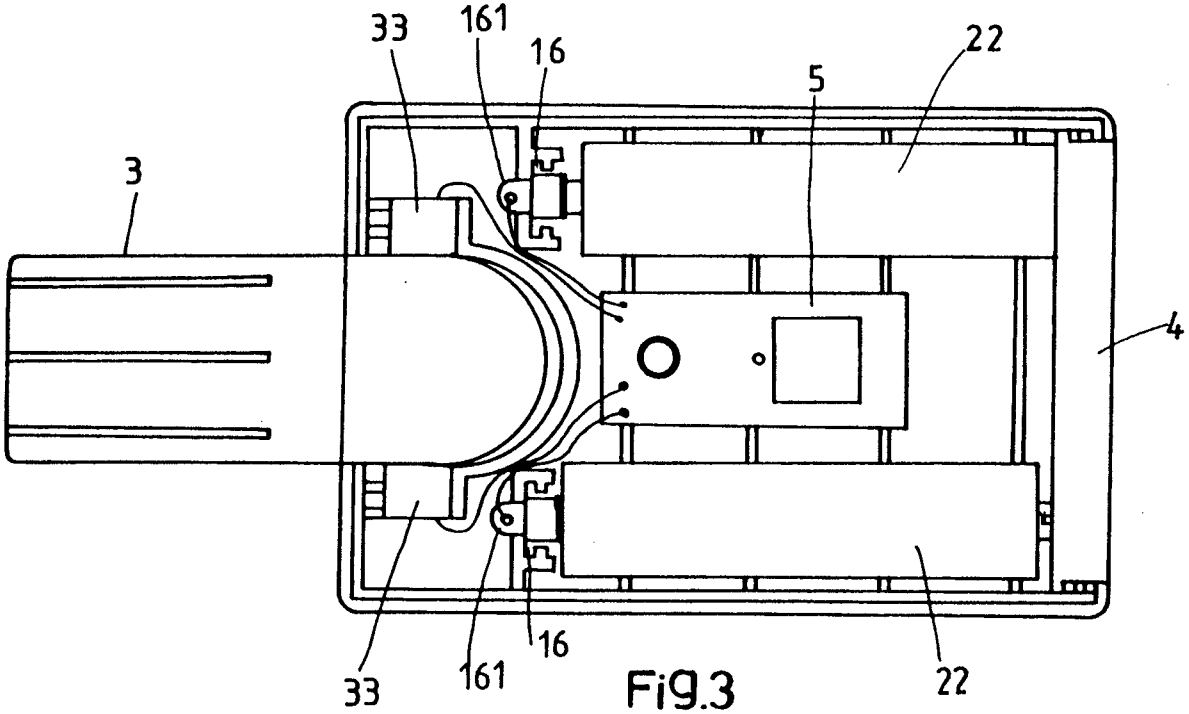
FIG. 3 is a top plan view thereof.
Figure 4:
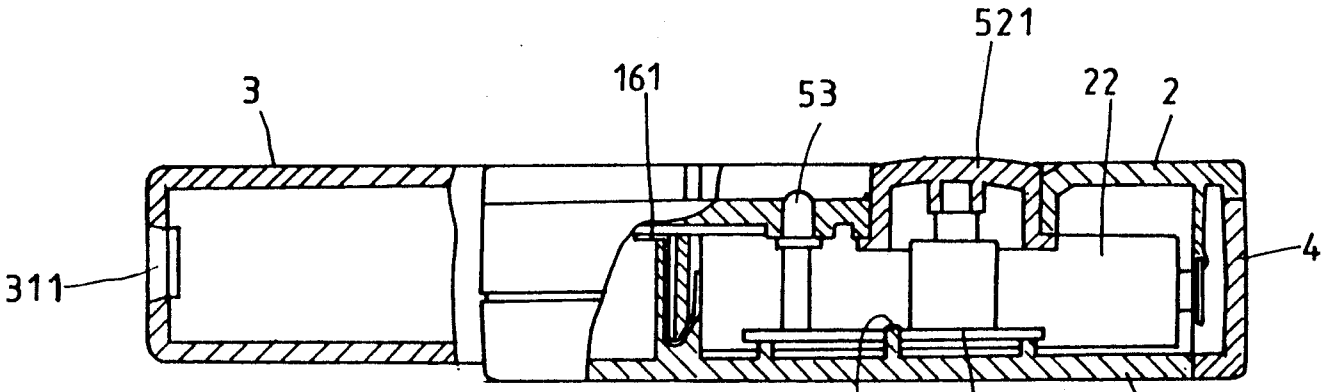
FIG. 4 is a front plan view thereof.
Figure 5:
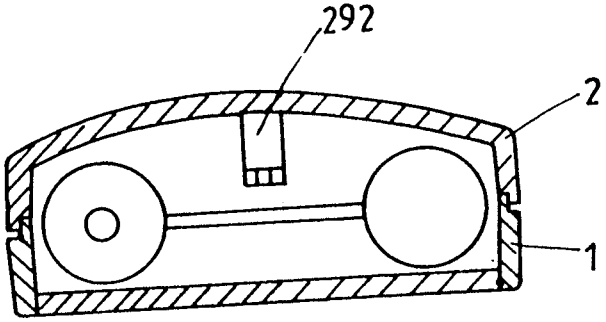
FIG. 5 is a right side plan view thereof.
Figure 6:
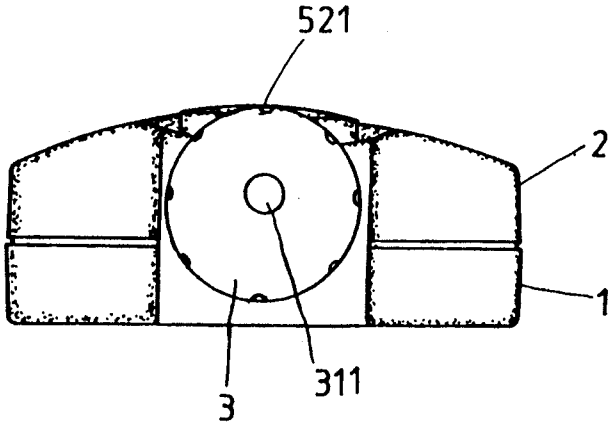
FIG. 6 is a left side plan view thereof.
Figure 7:
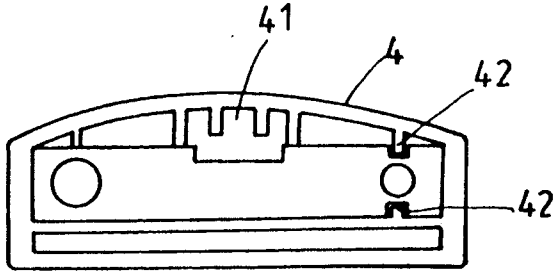
FIG. 7 is a plan view of the battery cap.

Referring to FIGS. 1 through 7, a laser indicator as constructed in accordance with the present invention is generally comprised of a bottom shell 1, a top shell 2, a laser module 3, a battery cap 4, and a circuit board 5.

The bottom shell 1 comprises a plurality of upright supporting boards 11 respectively formed into a plurality of smoothly curved supports 111, a plurality of retaining notches 12 symmetrically made on two opposite sides thereof, an upright locating pin 112 at the center, two opposite dowels 13 raised from two opposite front corners thereof, an U-shaped front opening 14 on a front end thereof between the dowels 13, two semi-circular pivot holes 141 transversely disposed on the periphery of the U-shaped opening 14 at two opposite sides, two retaining grooves 15 respectively and bilaterally disposed adjacent to the semi-circular pivot holes 141, two conductive spring leaves 161 mounted on two raised blocks 16 disposed between the U-shaped opening 14 and the upright supporting boards 11, and a rear chamber 17 transversely disposed on a rear end thereof.

The top shell 2 is symmetrical to the bottom shell 1, comprising a plurality of upright supporting boards 21 respectively formed into a plurality of smoothly curved supports 211 fitting over the smoothly curved supports 111 on the bottom shell 1 to hold dry batteries 22, a plurality of hooks 23 symmetrically disposed on two opposite sides thereof and respectively hooked in the retaining notches 12 on the bottom shell 1, two opposite dowel holes 24 on two front corners thereof, which receive the dowels 13 on the bottom shell 1, an U-shaped front opening 25 on a front end thereof between the dowel holes 24 disposed above the U-shaped front opening 14 on the bottom shell 1 for moving the laser module 3, two semi-circular pivot holes 251 transversely disposed on the periphery of the U-shaped opening 24 at two opposite sides, two retaining grooves 26 respectively aligned with the retaining grooves 15 on the bottom shell 1, a button hole 27 and a lamp hole 28 around the center, and a hook 292 on a rear chamber 291 thereof.

The laser module 3 comprises a laser firing lens mount 31 movably retained in the U-shaped openings 14,25 at the front of the bottom and top shells 1,2 by two symmetrical swivel connectors 321,322. The two symmetrical swivel connectors 321,322 are connected together by inserting dowels 3211 on one swivel connector 321 into dowel holes 3332 on the other swivel connector 322, and then pivotably fastened to the pivot holes 141,251 by pivots 33. The laser lens mount 31 has a laser firing hole 311 on the front, which may be covered with a laser firing lens, and a laser diode (not shown) on the inside electrically connected to the circuit board 5. The internal circuit of the laser module 3 can be easily achieved through ordinary techniques (This is not within the scope of the present invention, and therefore it is not described in details).

The battery cap 4 is inserted in the rear chambers 17,27 to electrically connect the dry batteries 22 into a power supply circuit, having a hook 41 hooked up with the hook 292 on the top shell 2 and a projecting rod 42 to prevent from error installation of the dry batteries 22.

The circuit board 5 is fastened between the bottom and top shells 1,2 on the inside and electrically connected to the laser module 3 to control its operation. The circuit board 5 comprises a pin hole 51, into which the locating pin 112 on the bottom shell 1 fits, a key switch 52 having two opposite ends respectively connected to the two conductive spring leaves 161, a press button 521 mounted on the key switch 52 and inserted through the button hole 27 and pressed to switch on/off the key switch 52, and a power indicator lamp 52 inserted through the lamp hole 28.

Figure 8:
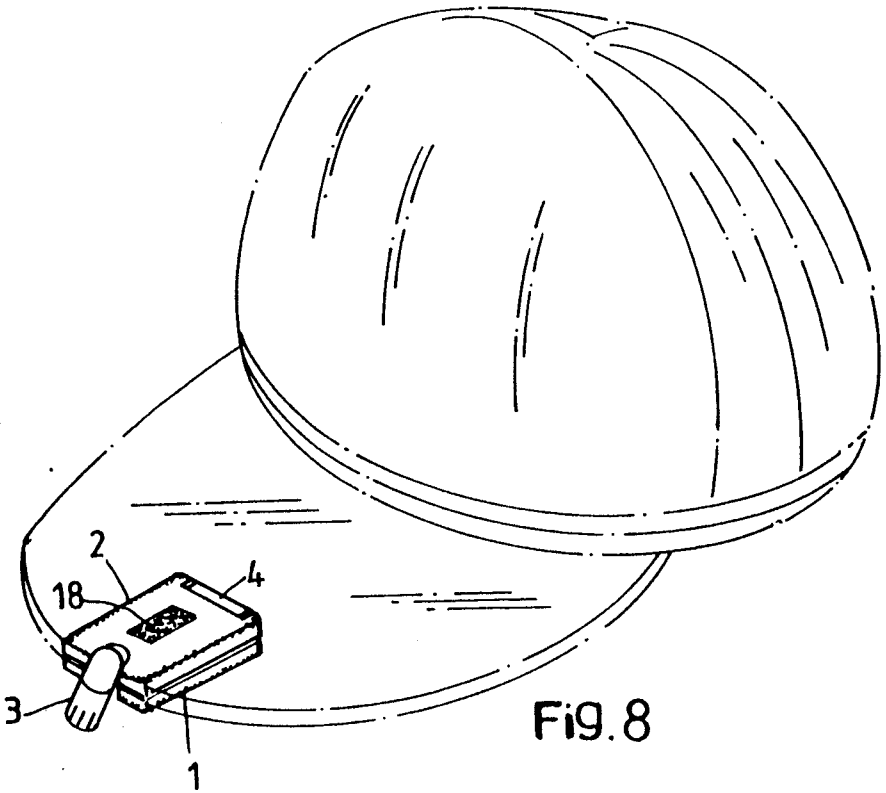
FIG. 8 illustrates an installed view showing the laser indicator fastened to the visor of a cap.
Figure 9:
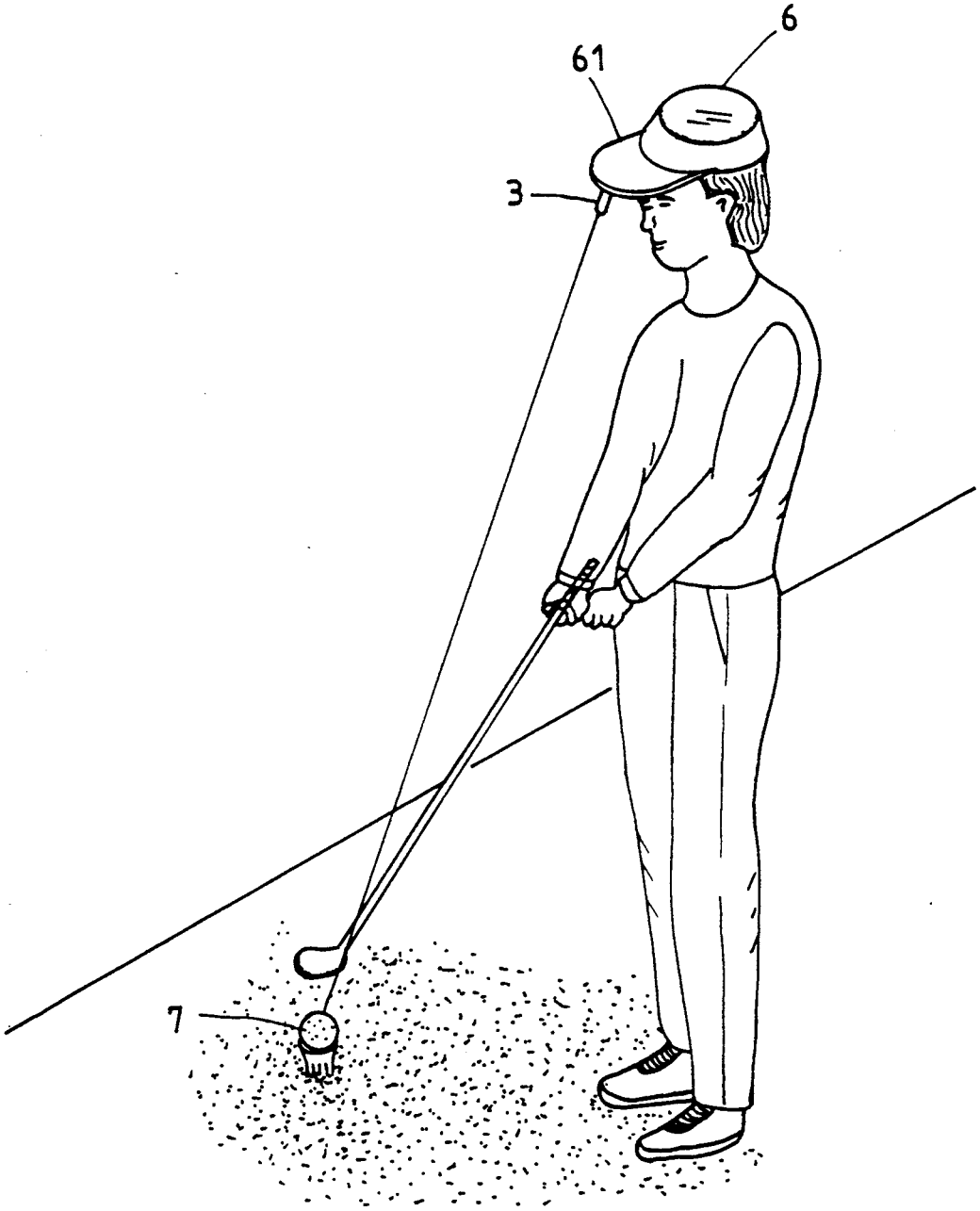
FIG. 9 is a pictorial drawing showing the operation of the present invention in guiding the user to hit the ball.
Figure 10:
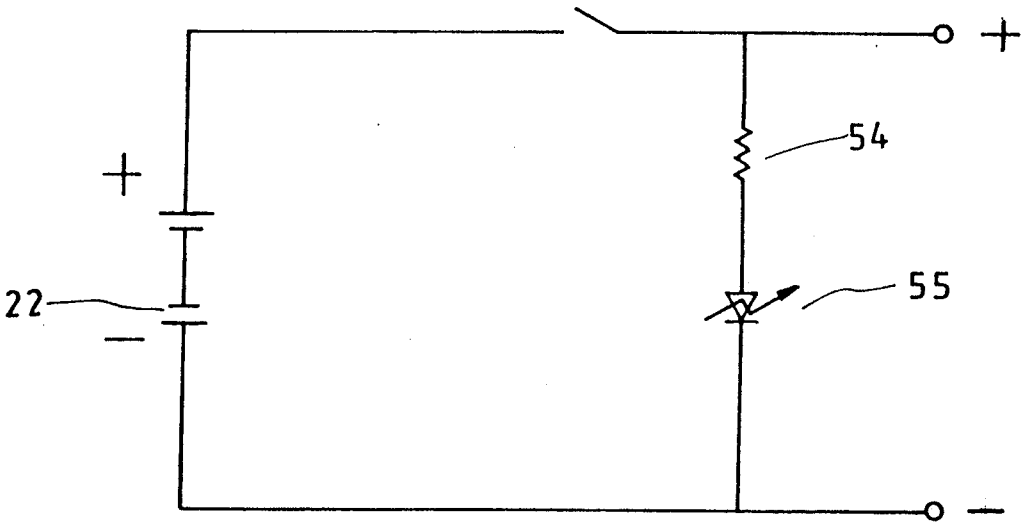
FIG. 10 is a circuit diagram according to the present invention.

Referring to FIGS. 8, 9 and 10, the laser indicator may be fastened to the visor 61 of a cap 6 by a magic tape (VELCRO tape) 18 and operated to help the user in hitting the ball. As the press button 521 is pressed to switch on the key switch 52, the circuit board 5 is electrically connected to the dry batteries 22 to turn on the power indicator lamp 53 and a laser diode 55 via a resistor 54, causing the laser diode 55 to project a laser beam through the laser firing hole 311. The laser firing lens mount 31 is then turned on the bottom and top shell 1,2 to adjust the projecting direction of the laser beam toward the ball 7. This arrangement helps the player to keep the head in position while hitting the ball 7. If the player moves the head, the laser beam is immediately moved from the ball 7, and therefore the player is advised of being taking a wrong position. Therefore, the present invention is practical in helping a golf player to keep in position while hitting the ball.

What is claimed is:

1. A laser indicator comprising:

a bottom shell having smoothly curved battery supports aligned in rows, retaining notches symmetrically made on two opposite sides thereof, an upright center locating pin, two opposite dowels raised from two opposite front corners thereof, a U-shaped front opening on a front end thereof with the two semi-circular pivot holes transversely and bilaterally extended outwards, two conductive spring leaves mounted on two raised blocks disposed between the U-shaped opening and the battery supports, and a rear chamber transversely disposed on a rear end thereof;

a top shell having smoothly curved battery supports fitted over the smoothly curved battery supports on said bottom shell to hold a set of dry batteries, a plurality of hooks symmetrically disposed on two opposite sides thereof and respectively hooked in the retaining notches on said bottom shell, two opposite dowel holes on two front corners thereof, which receive the dowels on said bottom shell, a U-shaped front opening on a front end thereof with two semi-circular pivot holes transversely and bilaterally extended outwards, the two semi-circular pivot holes on said bottom shell being incorporated with the two semi-circular pivot holes on said top shell into two pivot holes, a button hole and a lamp hole, and a hook on a rear chamber thereof;

a laser module having a laser firing lens mount pivotably retained in the U-shaped openings of said front and bottom shells by two symmetrical swivel connectors, said two symmetrical swivel connectors being connected together by inserting dowels on one swivel connector into dowel holes on the other swivel connector and pivotably fastened to. the pivot holes on the U-shaped front openings of said bottom and top shells;

a battery cap inserted in the rear chambers of said top and bottom shell and hooked in place by the hook on the rear chamber of said top shell to connect said set of dry batteries;

a circuit board fastened between said bottom and top shells on the inside and electrically connected with said laser module and a set of dry batteries, having a pin hole, into which the locating pin on said bottom shell fits, an ON/OFF power switch controlled by a press button inserted through said button hole on said top shell, and a power indicator lamp inserted through said lamp hole on said top shell; and a visor fastening means wherein said top shell is adapted to be fastened to the visor of a golf player's cap by said fastening means to hold said laser module in position for permitting it to be controlled by said press button to project a laser beam on the golf ball to be hit by the golf player, in helping the golf player take the correct hitting position.

* * * * *